United States Patent [19]

Konneker

[11] Patent Number: 4,570,341

[45] Date of Patent: Feb. 18, 1986

[54] POCKETKNIFE WITH INTEGRAL RING FASTENER

[76] Inventor: Lloyd K. Konneker, 1810-A Ashborough Rd., Marietta, Ga. 30067

[21] Appl. No.: 617,023

[22] Filed: Jun. 4, 1984

[51] Int. Cl.[4] ..... B26B 1/04

[52] U.S. Cl. ..... 30/161; 7/118; 30/151; 30/155

[58] Field of Search ..... 30/160, 161, 164, 159, 30/151, 155–157; 7/118–120, 160; 145/61 R; 224/232, 233

[56] References Cited

U.S. PATENT DOCUMENTS 900,339 10/1908 Woodruff ..... 7/119 X
2,896,290 7/1959 Salm et al. ..... 7/118 X

FOREIGN PATENT DOCUMENTS 17031 of 1903 United Kingdom ..... 30/296

*Primary Examiner*—Douglas D. Watts
*Attorney, Agent, or Firm*—Thomas & Kennedy

[57] ABSTRACT

A pocketknife is formed with a latching mechanism that includes a catch and latch for releasibly holding a key ring.

4 Claims, 14 Drawing Figures

POCKETKNIFE WITH INTEGRAL RING FASTENER

TECHNICAL FIELD

This invention relates to knives of the type having a blade that may be folded into a handle which are commonly referred to as pocketknives.

BACKGROUND OF THE INVENTION

Pocketknives have a blade mounted to a housing, which serves both as a sheath and as a handle, for pivotable movement between sheathed and unsheathed positions. They are well known in the art as exemplified by those illustrated in U.S. Pat. Nos. 3,568,315, 4,148,140 and 4,302,877. Such knives are well suited for general purpose, occasional use while carried on a person as in men's trouser pockets and in ladies' handbags since they may assume a compact configuration with their blade safely stowed. Keys constitute another personal article that are carried in a similar manner. Typically, they are grouped as a set placed on a key ring or on an endless key chain which, for purposes of this application, is also considered to be a ring.

Heretofore, devices have been conceived for holding a key or a set of keys together with another type of article. For example, in U.S. Pat. Nos. 2,706,902 and 2,982,454 combination devices for personal use are disclosed that have sheathes in which both a key as well as a nail file and a knife blade may be positioned. U.S. Pat. No. 4,317,638 discloses a holder for holding both a key ring and a writing pen. In U.S. Pat. No. 4,312,128 a device is taught for attaching a key ring or key chain to a cutting blade.

Although some of the just described devices have been capable of coupling together useful tools, their structural shapes have been quite different from those of conventional pocketknives. For example, they have typically been of simple, light weight design having small blades of specialized shape and duty. Their blades have often been constructed to be detachable from the holder for use. They have typically had no interlock mechanism for holding their blades in either a sheathed or in an unsheathed position. Thus, their structure and form has been designed at a sacrifice of attributes attributable to conventional pocketknife designs which today have reached a high degree of refinement. Therefore, it is seen that a need remains for a pocketknife of a generally conventional construction that may be used without blade detachment and to which a key ring may be releasibly fastened securely and with facility. It is to the fulfullment of such need that the present invention is primarily directed.

SUMMARY OF THE INVENTION

In a preferred form of the invention a combination article comprises cutting means that includes a blade pivotably mounted to a blade housing and latching means for releasibly holding a key ring to the cutting means that includes cooperating catch and latch means.

In another form of the invention a pocketknife comprises a housing that includes a pair of juxtaposed side plates, a blade having a tang pivotably mounted to one end of the pair of side plates, interlock means for releasibly holding the blade in an unsheathed position with respect to the side plates, and latching means for releasibly holding a key ring to the housing.

In yet another form of the invention a foldable knife comprises a sheath that includes a pair of side plates spaced apart by a bar. A blade has a blade tang pivotably mounted to the sheath for movement between a sheathed position with a blade cutting edge located within the sheath and an unsheated position with the blade cutting edge located outside the sheath. The foldable knife also includes latching means for releasibly latching a key ring to the sheath.

DETAILED DESCRIPTION

Figure 1:
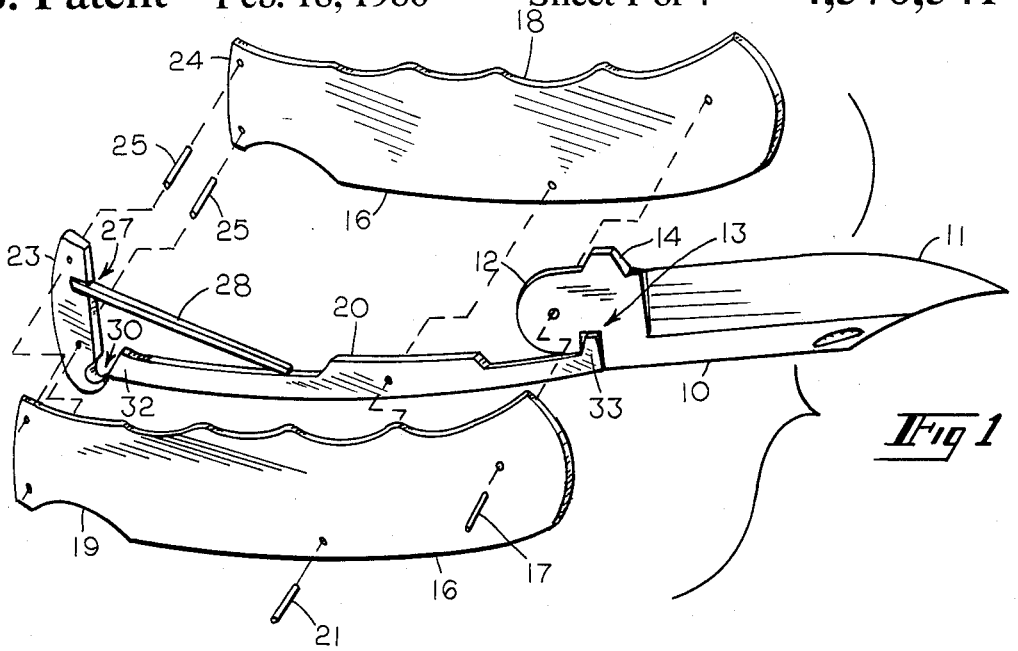
FIG. 1 is an exploded view, in perspective, of a pocketknife embodying principles of the invention in one form.
Figure 2:
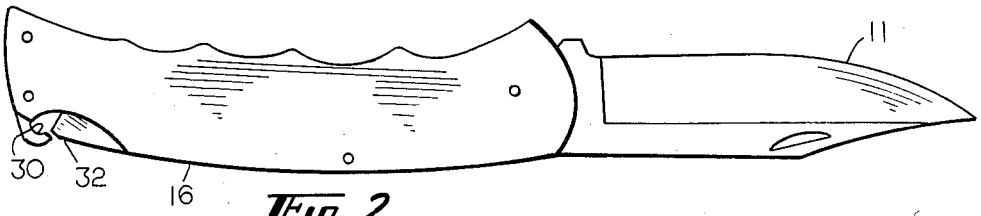
FIG. 2 is a side elevational view of the pocketknife illustrated in FIG. 1 shown with the knife blade in an unsheathed position.

With reference to the drawings, there is shown in FIGS. 1–4 a pocketknife having a blade 10 formed with a cutting edge 11 and a tang 12 which is formed with a notch 13 and with a lobe 14 that serves as a blade stop. The blade tang is pivotably mounted to one end of a pair of identical side plates 16, that form a housing or sheath for the blade as well as a handle, by means of a pin 17 that extends through aligned holes in the blade tang and the side plates. An edge 18 of each side plate is furrowed to provide a finger grip. A lockbar 20 is pivotably mounted by another pin 21 to a midportion of the two side plates 16. A spacer 23 is mounted between ends 24 of the two side plates by means of two pins 25 that extend through aligned holes in the side plates end 24 and in the spacer bar 23. The spacer bar is provided with a notch 27 in which an end of a leaf spring 28 is mounted. The sloping orientation of the notch 27 is such as to place the leaf spring in spring biased engagement with an edge of the lock bar, as shown. A lower end of the spacer extends out from between the two side plates and is provided with a rounded notch 30 that provides a catch member of a latch. An end 32 of the lock bar 20 is seen to be positioned adjacent the notch 30 and exposed to ambience within a cutout 19 formed in the edge of the side plates opposite edge 18. The lockbar end 32 functions as a latch bar while the opposite end of the lockbar 20 is provided with a tooth 33 that may be seated within the notch 13 formed in the blade tang to provide an interlocking mechanism.

Figure 4:
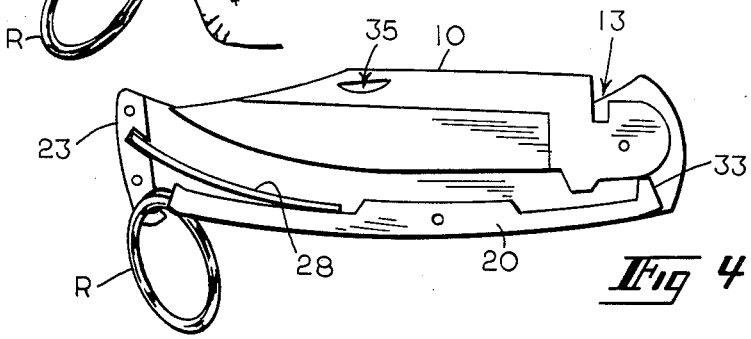
FIG. 4 is another side elevational view of the knife as illustrated in FIG. 3 shown with its latching means in a latched position holding a key ring.

With the components of the knife assembled the blade may be stowed in the sheathed orientation shown in FIG. 4. When it becomes desirable to use the knife the blade 10 may be pulled by placing a fingernail within a grip recess 35 and by then rotating the blade clockwise. Once the blade has been rotated approximately a half turn the spring biased lockbar tooth 33 becomes interlocked within the notch 13, as shown in FIG. 1, thereby holding the blade firmly in its unsheathed position shown in FIG. 2. Once it is desired to return the blade 10 to its sheathed position the exposed end 32 of the lockbar is depressed whereupon the lockbar tooth 33 is moved out of interlocking engagement with the blade by being removed from notch 13. With the blade released it may be easily rotated back to its stowed or sheathed position.

Figure 3:
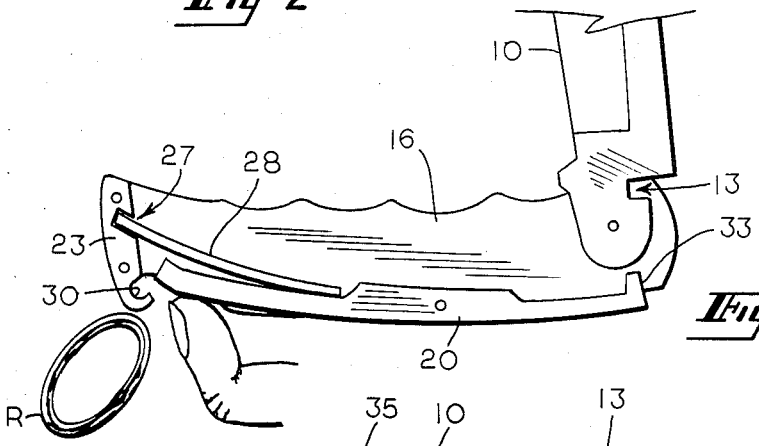
FIG. 3 is a side elevational view of the pocketknife illustrated in FIG. 1 shown with one side plate removed to reveal internal structural features and with its latching means shown in an unlatched position with a key ring being released thereform.

It will also be seen that not only may the blade be moved between sheathed and unsheathed positions, but the latch means may also be moved between latched and unlatched positions by operation of the lockbar, as most clearly shown in FIG. 3. With the lockbar manually depressed as shown here, it is moved away from a position closing the catch provided by notch 30 whereupon a key chain or key ring, as indicated by ring R, may be passed between the end of the catch and the end of the lockbar and seated within the notch 30. The ring R itself may be used to depress the lockbar. Once finger pressure is removed from the lockbar, it returns under the bias provided by leaf spring 28 to a position closing the catch or notch 30 as shown in FIG. 4. At all times the end 32 of the lockbar is prevented from rotating counterclockwise beyond a position in which the catch or notch 30 is closed by the engagement of the end 33 of the lockbar with the tang 12 of the blade. Thus, in the position shown in FIG. 4, the ring R may not be pulled free. Here the latching means for a key ring may be opened at all times regardless of the position of the blade.

Figure 5:
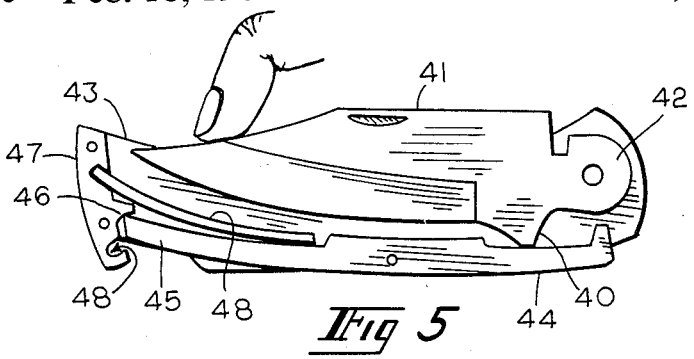
FIG. 5 is a side elevational view with a side plate removed of a pocketknife embodying principles of the invention in an alternative form.

An alternative form of the pocketknife is illustrated in FIG. 5. Here a lobe or projection 40 is formed on a blade 41 adjacent to the blade tang 42. When the blade is sheathed between side plates 43 and manually depressed, as shown, lobe 40 rotates a lockbar 44 clockwise against a leaf spring 48 causing its end 45 to move into contact with a stop 46 that projects outwardly from a spacer 47 thereby opening a catch 48 formed in a lower, exposed portion of the spacer. Thus here the latching means for holding a key ring is opened by depression of the blade rather than by depression of the lockbar as done in the previously described embodiment.

Figure 6:
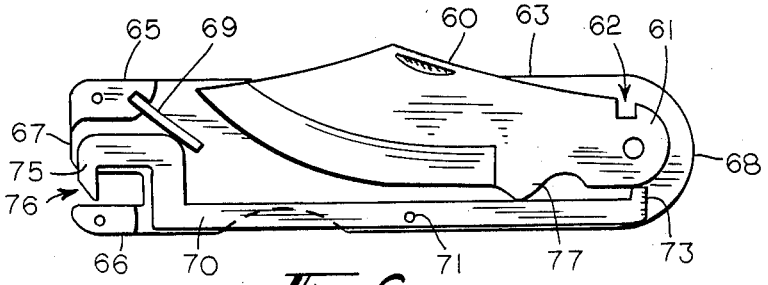
FIG. 6 is a side elevational view of a pocketknife with a side plate removed which embodies principles of the invention in another alternative form.

The embodiment of FIG. 6 differs from those of FIGS. 1–4 and FIG. 5 primarily in the location of the key ring latching means. The pocketknife here comprises a blade 60 having a tang 61 formed with a notch 62 which tang is pivotably mounted between a pair of side plates 63. Two spacer bars 65 and 66 are mounted to an end 67 of the side plates opposite the end 68 to which the blade tang is pivotably mounted. A leaf spring 69 is secured within a notch formed in the spacer 65 in spring biasing engagement with a lockbar 70 that is pivotably mounted by pin 71 between the two side plates. The lockbar 70 is formed with a tooth 73 for interlocking engagement within the notch 62 formed in the blade tang. The other end of the lockbar is formed with a hook 75 which is shown substantially closing a notch or catch 76 formed in the end 67 of the side plates. Thus, the latching means provided by hook 75 and notches 76 is shown here closed. When it becomes desirable to open the latching means the spring biased lockbar is rotated clockwise thereby causing the hook to move upward opening the exit of notch 76.

Figure 7:
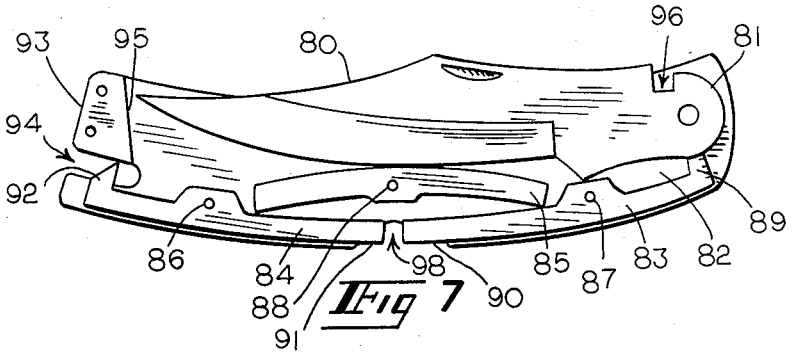
FIG. 7 is a side elevational view of a pocketknife shown with a side plate removed which embodies principles of the invention in yet another form.

The pocketknife of FIG. 7 is seen to include a blade 80 having a tang 81 formed with a notch 96 pivotably mounted between two side plates 82. This embodiment includes a segmented lockbar system which includes a first bar 83 and a second bar 84 each of which bears against a leaf spring 85 which is mounted to the side plates by a pin 88. One end of the spring 85 bears against bar 83 to the left of its pivot pin 87 while the other end of the spring bears against bar 84 to the right of its pivot pin 86. An end 90 of bar 83 and an end 91 of bar 84 adjacent thereto extend into a cut out area 98 in the two side plates. Another end 89 of bar 83 is formed with a tooth which slides against the periphery of tang 81 with rotation of the blade. The other end 92 of the bar 84 is also in the form of a tooth which projects over a catch or notch 94 formed in an end of the side plates beneath a spacer and stop 93 thereby blocking the exit of the catch. So configured, the blade interlock system provided by tooth 89 and tang notch 96 and the latch system provided by catch 94 and lockbar tooth 92 may be operated simultaneously or separately by inserting a finger within the cut out area 98 and depressing the bar ends 90 and 91 against spring 85. With the blade sheathed, as shown, only the latch system is, of course, actuated.

Figure 8:
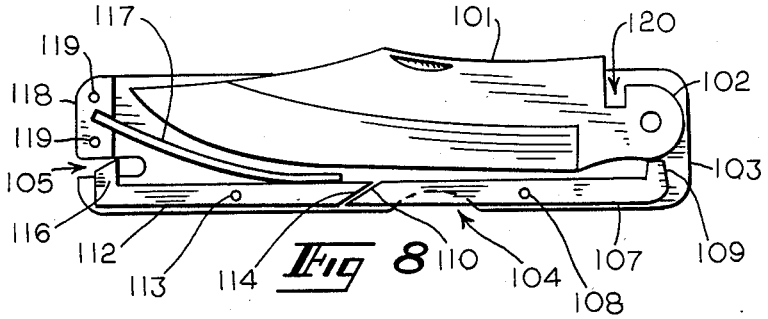
FIG. 8 is a side elevational view of a pocketknife shown with a side plate removed which embodies principles of the invention in still another form.

In the embodiment illustrated in FIG. 8 a blade 101 has its tang 102 rotatably mounted to a pair of side plates 103 that are formed with a cut out area 104 and a notch 105. Here too the pocketknife is provided with a segmented lock bar system having one bar 107 pivotably mounted by pivot pin 108 to the side plates with an end tooth 109 urged against the blade tang 102 for locking engagement with a notch 120 formed in the tang. The bar extends through the side plate cut out areas 104 and terminates with a beveled end 110. A second bar 112 is pivotably mounted by pin 113 to the side plates which bar also has a beveled end 114 overlying the beveled end 110 of the bar 107. The bar 112 has a tooth or projection 116 that extends over the catch or notch 105 to serve as a latch bar. One end of a leaf spring 117 is mounted within a slot formed in a spacer 118 that is secured by pins 119 to the side plates. The leaf spring 117 is in spring biasing engagement with the bar 112 to the right hand side of pin 113 as viewed in the figure thereby urging it clockwise. In operation a user may place a finger within the cut out area 104 and rotate the bar 107 clockwise against the force of the leaf spring to remove bar tooth 109 from its interlocked position within the tang notch 120. In doing so, the bar 107 rotates bar 112 counterclockwise thereby clearing hook 116 from its position blocking the exit of notch 105, thereby enabling a key ring to be removed from or placed within the notch. Of course, if the blade is in its sheathed position, as shown in FIG. 8, tooth 109 is already dislodged from notch 120. Nevertheless, with this embodiment one manual motion may again serve to perform two functions, namely that of releasing the interlock as well as that of operating a key ring latch mechanism.

Figure 9:
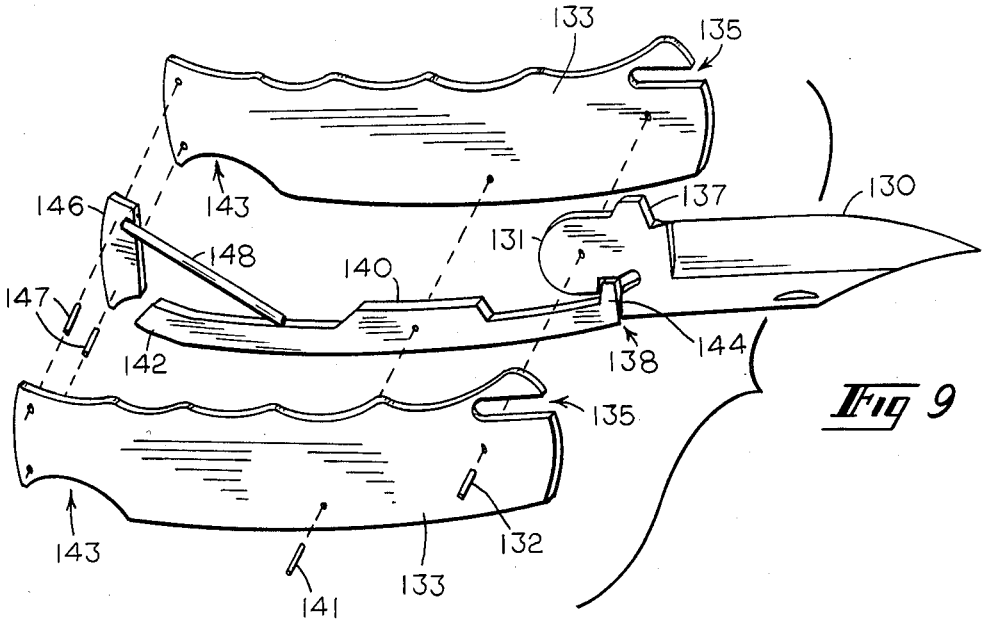
FIG. 9 is an exploded view, in perspective, of a pocketknife which embodies principles of the invention in still another preferred form.
Figure 10:
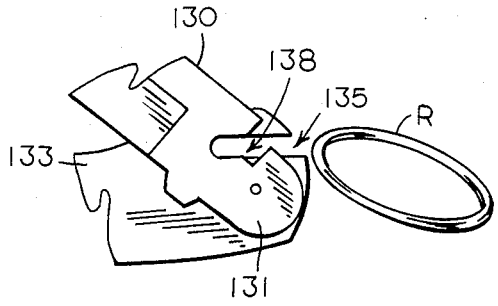
FIG. 10 is a fragmentary side elevational view of the pocketknife illustrated in FIG. 9 showing a latch portion thereof in a latch open position.
Figure 11:
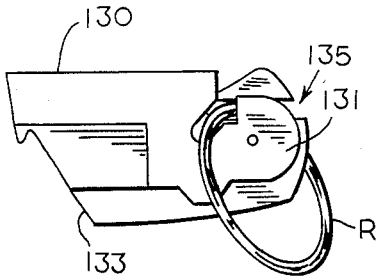
FIG. 11 is a fragmentary side elevational view of the pocketknife illustrated in FIG. 9 showing a latch portion thereof in a latch closed position.

With reference next to FIGS. 9–11 the pocketknife here is seen to comprise a blade 130 having a tang 131 pivotably mounted by a pin 132 to two side plates 133 which are formed with a catch provided by aligned slots 135 in the ends thereof to which the blade tang is pivotably mounted. The blade 130 is formed with a lobe 137 and a slot 138. A single lockbar 140 is pivotably mounted by a pivot pin 141 between the two side plates so as to have an end 142 accessible to ambience for manual depression as by a finger inserted into a cut out area 143 formed along an edge of the two side plates. The other end 144 of the lockbar is in the shape of a tooth configured for seating engagement within the tang slot 138. A spacer 146 is mounted by pins 147 to the side plate adjacent the cut out area 143. The spacer 146 is provided with a slot in which one end of the leaf spring 148 is press fitted. The other end of the spring is in biasing engagement with an edge of the lockbar 140.

The manner in which latching is achieved here is illustrated in FIGS. 10 and 11. In FIG. 10, it is seen that the slots 135 and 138 are sufficiently aligned by the relative rotary positions of the blade tang and the sideplates so as to provide access to the bottom of the slot 138 and ambience for a ring R to be passed freely into and out thereof. This is achieved with the blade generally in the position illustrated in FIG. 10. Once the blade is sheathed, as illustrated in FIG. 11, the exit of the slot 135 is closed by a portion of the tang 131. In the fully open position the blade completely blocks off the slot 135. Thus here the latch is open for ring insertion in only the specific position of the blade shown in FIG. 10 and the latch is closed to capture a ring in only the specific position of the blade shown in FIG. 11. By continuously pulling on a latched ring as the blade is swung, the ring will, of course, become detached as the blade passes through the position of FIG. 10.

Figure 12:
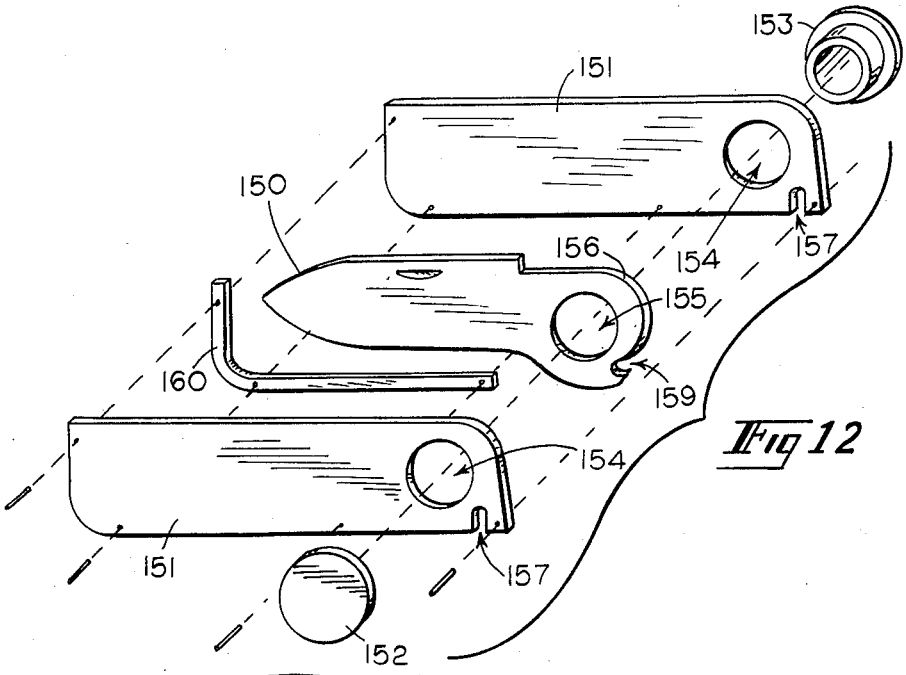
FIG. 12 is an exploded view, in perspective, of a pocketknife embodying principles of the invention in yet another preferred form.
Figure 13:
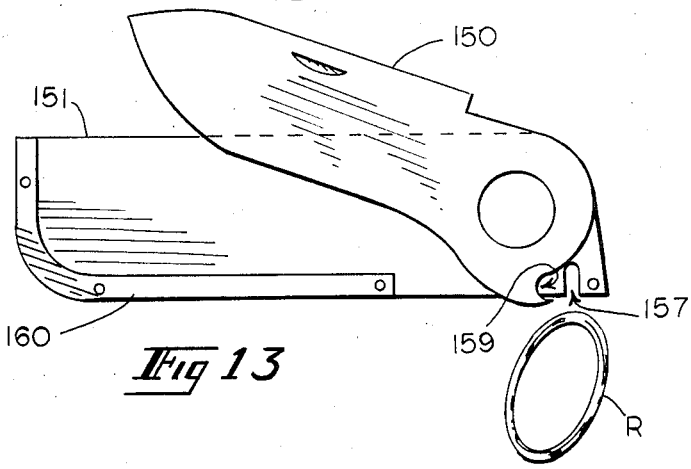
FIG. 13 is a side elevational view of the pocketknife illustrated in FIG. 12 with a side plate removed in a latch open position.
Figure 14:
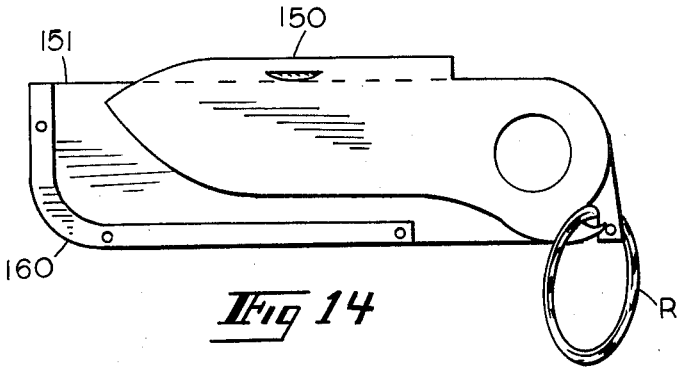
FIG. 14 is a side elevational view of the pocketknife illustrated in FIG. 12, with a side plate removed, shown in a latch closed position.

Finally, with reference to FIGS. 12–14, still another embodiment of the invention is shown which does not include a lockbar and spring as do the other embodiments. Here, the pocketknife includes a blade 150 mounted between two side plates 151 by cylindrical, telescoping locking members 152 and 153 which pass through aligned holes 154 in the side plates and hole 155 in the blade tang 156. These locking members may be of the same structure as of those detailed in the previously mentioned Patent No. 4,148,140. Each side plate has a catch or notch 157 adjacent its hole 154. The blade tang is formed with a latch-like or hook-shaped notch 159. A combination spacer and blade stop 160 is mounted between the two side plates. With this embodiment the latching means provided by the combination of blade tang notch 159 and the side plate notches 157 is seen to be open or unlatched in all rotary positions of the blade except that of its closed or sheathed position as illustrated in FIG. 14. Therefore, in this embodiment, quite contrary to the embodiment of FIGS. 9–11, a ring R may be releasibly latched to the pocketknife when it is in its closed position but inserted into the notch 157 when in all unsheathed positions. The locking members 152 and 153 serve to releasibly lock the blade in either the open or closed position. When the blade is locked in the closed position illustrated in FIG. 14, the captured ring R may not be pulled free of the latching means.

It thus is seen that a pocketknife is provided to which a key ring or key chain or similar type article may be releasibly attached. Though several different embodiments have been illustrated it should be understood that these merely illustrate preferred forms of the invention. Many modifications, additions and deletions may therefore be made thereto without departure from the spirit and scope of the invention as set forth in the following claims.

I claim:

1. An article of manufacture comprising, in combination, cutting means that includes a blade pivotably mounted to a blade housing and latching means for releasibly holding a key ring to said cutting means that includes cooperating catch means and latch means with said catch means defining a catch exit and said latch means being mounted for movement relative to said catch means into and out of positions restricting said exit, said latch means including a lockbar pivotably mounted to said blade housing for movement of a first lockbar end between a position closing said catch means exit to a position opening said catch means exit, and wherein a second end of said lockbar is spring biased into engagement with the tang of said blade.

2. The article of claim 1 wherein said blade tang is formed with a notch and wherein said second end of said lockbar is formed with a tooth for releasibly interlocking engagement with said tang notch.

3. A foldable knife comprising a sheath that includes a pair of side plates spaced apart by a bar pivotably mounted to said side plates, a blade pivotably mounted to said sheath for movement between a sheathed position with a blade cutting edge located within the sheath and an unsheathed position with the blade cutting edge located outside said sheath, and latching means for releasibly latching a key ring to said sheath that includes catch means defining a catch exit and latch means mounted for movement relative to said catch means into and out of positions restricting said exit, and wherein said latch means includes a latch on an end of said bar and a catch on said sheath adjacent said latch.

4. The knife of claim 3 further comprising spring means for biasing one end of said bar into engagement with the tang of said blade and for biasing said latch on the bar end opposite said one end into a position latching said catch closed.

* * * * *